US012022874B2

(12) United States Patent
Chen

(10) Patent No.: US 12,022,874 B2
(45) Date of Patent: Jul. 2, 2024

(54) ATOMIZING UNIT WITH CIRCUITOUS AIR PASSAGE AND ATOMIZATION ASSEMBLY

(71) Applicant: Shenzhen Huachengda Precision Industry Co. Ltd., Guangdong (CN)

(72) Inventor: Ping Chen, Guangdong (CN)

(73) Assignee: Shenzhen Huachengda Precision Industry Co. Ltd., Shenzhen (CN)

( * ) Notice: Subject to any disclaimer, the term of this patent is extended or adjusted under 35 U.S.C. 154(b) by 421 days.

(21) Appl. No.: 17/624,267

(22) PCT Filed: Aug. 25, 2020

(86) PCT No.: PCT/CN2020/111129

§ 371 (c)(1),
(2) Date: Dec. 31, 2021

(87) PCT Pub. No.: WO2022/040930

PCT Pub. Date: Mar. 3, 2022

(65) Prior Publication Data

US 2022/0304390 A1 Sep. 29, 2022

(51) Int. Cl.
*A24F 40/46* (2020.01)
*A24F 40/42* (2020.01)
*A24F 40/485* (2020.01)

(52) U.S. Cl.
CPC ..... *A24F 40/485* (2020.01); *A24F 40/42* (2020.01); *A24F 40/46* (2020.01)

(58) Field of Classification Search
CPC ..... A24F 40/10; A24F 40/42; A24F 40/46; A24F 40/44; A24F 1/14
See application file for complete search history.

(56) References Cited

U.S. PATENT DOCUMENTS

| | | | | |
|---|---|---|---|---|
| 9,681,688 | B1 * | 6/2017 | Rinehart | A24F 40/40 |
| 9,986,769 | B1 * | 6/2018 | Liu | A24F 40/40 |
| 10,743,583 | B2 * | 8/2020 | Reevell | H05B 3/44 |
| 10,856,581 | B2 * | 12/2020 | Qiu | A24F 40/40 |
| 11,951,248 | B2 * | 4/2024 | Hepworth | H05B 6/108 |
| 2014/0109921 | A1 * | 4/2014 | Chen | A24F 40/44 131/273 |
| 2014/0216483 | A1 * | 8/2014 | Alima | A24F 40/46 131/329 |
| 2015/0272218 | A1 * | 10/2015 | Chen | A61M 15/06 131/329 |
| 2016/0157523 | A1 * | 6/2016 | Liu | A24F 40/51 392/395 |

(Continued)

*Primary Examiner* — Truc T Nguyen

(57) ABSTRACT

An atomizing unit with a circuitous air passage, including a base, an outer cover, a liquid conducting member, a supporting member, and a heating member. A first air hole and a second air hole communicating with the first air hole are defined in the base; a third air hole is defined in the outer cover; an accommodating cavity is defined in the liquid conducting member and extends through two sides thereof; a groove is defined in an outer side of the supporting member, and the second air hole faces a bottom surface of the supporting member; the supporting member supports the heating member to be attached to an inner side of the liquid conducting member; the groove and the heating member define a ventilation passage communicated with the third air hole; at least a part of the bottom surface of the supporting member and the base define an air space.

20 Claims, 10 Drawing Sheets

(56) References Cited

U.S. PATENT DOCUMENTS

| | | | | |
|---|---|---|---|---|
| 2016/0183596 | A1* | 6/2016 | Rado | F22B 1/284<br>392/404 |
| 2017/0049153 | A1* | 2/2017 | Guo | H05B 3/18 |
| 2018/0235281 | A1* | 8/2018 | Wang | A24F 40/485 |
| 2019/0053539 | A1* | 2/2019 | Davis | A24F 40/44 |
| 2019/0116872 | A1* | 4/2019 | Qiu | A24D 3/18 |
| 2019/0313696 | A1* | 10/2019 | Ding | A24F 40/46 |
| 2020/0000146 | A1* | 1/2020 | Anderson | A24F 40/90 |
| 2020/0113244 | A1* | 4/2020 | Novak, III | A24F 40/46 |
| 2020/0163381 | A1* | 5/2020 | Qiu | A24F 40/46 |
| 2020/0288789 | A1* | 9/2020 | Kleizo | A24F 40/485 |
| 2024/0023631 | A1* | 1/2024 | Decker | A24F 40/51 |

* cited by examiner

ATOMIZING UNIT WITH CIRCUITOUS AIR PASSAGE AND ATOMIZATION ASSEMBLY

TECHNICAL FIELD

The present disclosure relates to the field of atomization technology, and more particularly, to an atomizing unit with a circuitous air passage and an atomization assembly.

BACKGROUND

An atomizing unit typically includes a heating member which can heat liquid to generate aerosol, however, the leakage of the liquid entering an air passage or the condensate generated in the air passage may be easy to occur, which affects the use effect.

SUMMARY

The technical problem solved by the present disclosure is that, aiming to the above defect in the prior art, provides an atomizing unit with a circuitous air passage and an atomization assembly.

By solving the above technical problem, the present disclosure provides an atomizing unit with a circuitous air passage, wherein the atomizing unit includes:

a base, wherein a first air hole is defined in a bottom surface of the base and a second air hole is defined in a top surface thereof, and the first air hole is communicated with the second air hole;

an outer cover, wherein the outer cover is arranged on the base, and a third air hole is defined in the outer cover;

a liquid conducting member, wherein the liquid conducting member is arranged in the outer cover, and an accommodating cavity extending through two sides of the liquid conducting member is defined in the liquid conducting member;

a supporting member, wherein the supporting member is arranged in the accommodating cavity, and a groove is defined in an outer side of the supporting member, and the second air hole faces a bottom surface of the supporting member; and a heating member, wherein the heating member is arranged in the accommodating cavity and located between the liquid conducting member and the supporting member, and the supporting member supports the heating member to be attached to an inner side of the liquid conducting member and the liquid conducting member is configured to conduct liquid to the heating member; the heating member covers the groove of the supporting member such that the groove and the heating member define an ventilation passage, and the ventilation passage is communicated with the third air hole;

at least a part of the bottom surface of the supporting member and the base define an air space, and the air space communicates the second air hole with the ventilation passage such that airflow passes through the first air hole, the second air hole, the air space, the ventilation passage and the third air hole in sequence.

In an embodiment, the outer cover is provided with a liquid inlet hole communicating the liquid conducting member with an outer side of the outer cover; in the outer cover, the liquid inlet hole is separated from the ventilation passage and the air space, such that liquid outside the outer cover is in contact with the liquid conducting member and is then conducted to the heating member via the liquid conducting member.

In an embodiment, the liquid inlet hole is located at a position where the liquid conducting member is in contact with the outer cover, and the liquid inlet hole is arranged on an outer periphery of the third air hole.

In an embodiment, a protruding portion is provided on a top surface of the base, and the second air hole is defined in a top surface and/or a side surface of the protruding portion.

In an embodiment, a recess corresponding to the protruding portion is defined in the bottom surface of the supporting member, and the recess is distanced from the protruding portion for airflow to pass therethrough.

In an embodiment, the groove extends longitudinally, from the bottom surface of the supporting member to a top surface of the supporting member.

In an embodiment, a heat dissipation groove is defined in the supporting member which extends in a circumferential direction of the supporting member.

In an embodiment, the outer cover includes a first portion standing on the base and a second portion connected to an upper edge of the first portion and extending inwards, the first portion circumferentially surrounds a side surface of the liquid conducting member, and the second portion covers a top surface of the liquid conducting member, the third air hole is defined in the second portion, and the liquid inlet hole is defined in the first portion and/or the second portion.

In an embodiment, the outer cover includes a third portion standing on the second portion and surrounding the third air hole.

In an embodiment, the liquid conducting member is annular.

The present disclosure further provides an atomization assembly, wherein the atomization assembly includes a housing, an upper cover, and the above atomizing unit with the circuitous air passage; a liquid storage cavity and an air outlet passage are defined in the upper cover, a fourth air hole is defined in the upper cover, and the upper cover covers the third air hole; the atomizing unit and the upper cover are arranged in the housing, the fourth air hole is communicated with the air outlet passage, the liquid storage cavity is communicated with the liquid inlet hole, such that airflow can pass through the first air hole, the second air hole, and the air space, the third air hole, the fourth air hole and the air outlet passage in sequence.

In the present disclosure, the liquid conducting member, the supporting member, and the heating member are integrated in the outer cover, and the circuitous air passage defining by the first air hole, the second air hole, the air space, the ventilation passage, and the third air hole can prevent the leakage of the condensate or other liquids formed in the air passage.

BRIEF DESCRIPTION OF THE DRAWINGS

The present disclosure will be described in more detail with reference to the accompany drawings and the embodiments. It should be understood that the accompany drawings are only some embodiments of the present disclosure. For those skilled in the art, other drawings can be obtained from the accompanying drawings without creative effort.

Figure 1:
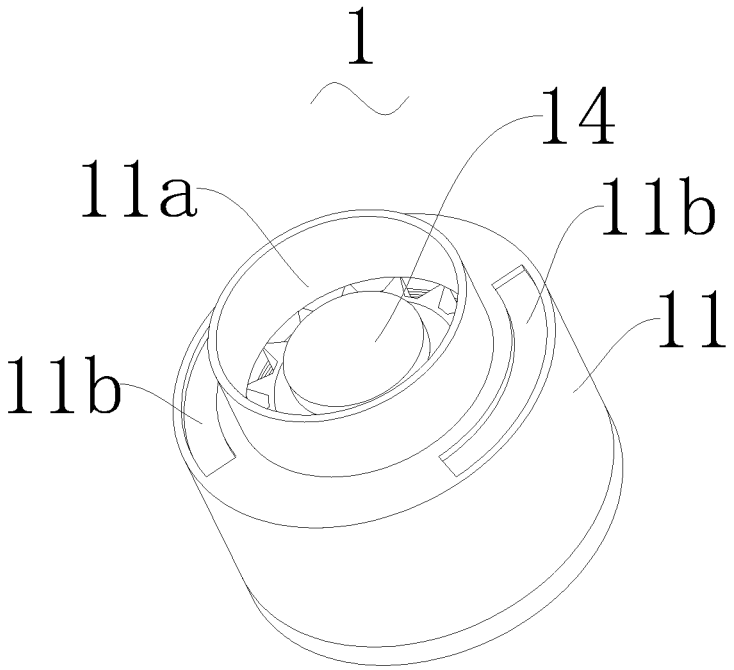
FIG. 1 is a perspective view of an atomizing unit according to a first embodiment of the present disclosure.
Figure 2:
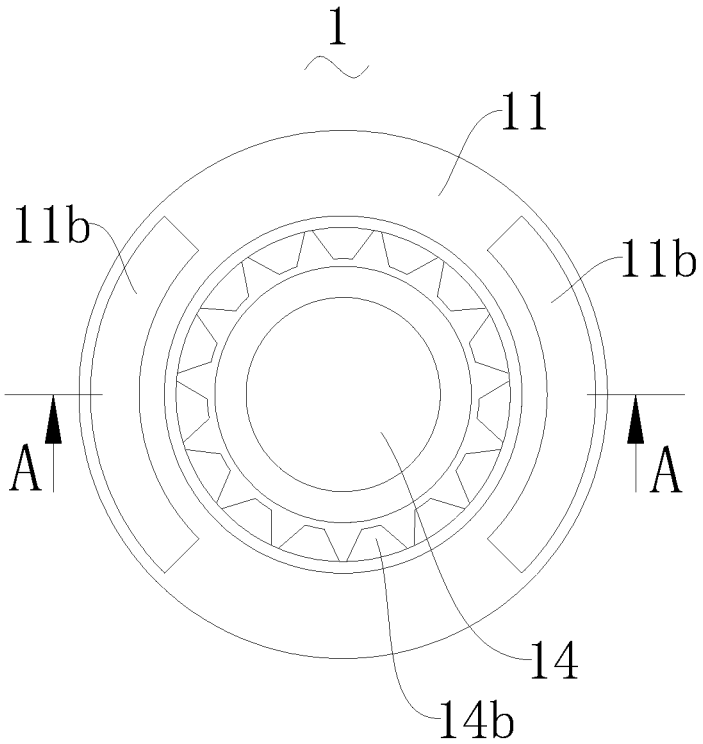
FIG. 2 is a top view of the atomizing unit of FIG. 1.
Figure 3:
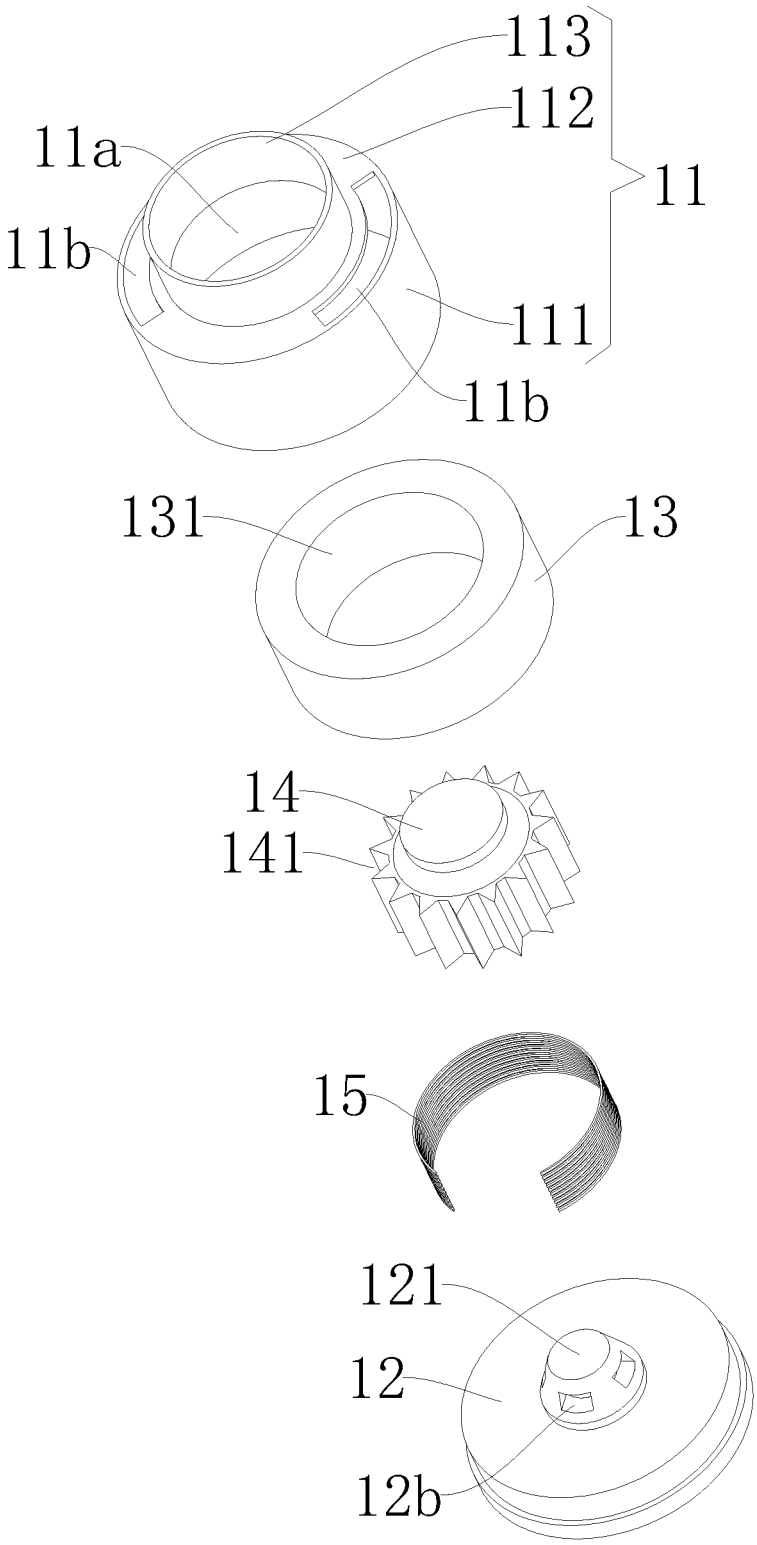
FIG. 3 is an exploded view of the atomizing unit of FIG. 1.
Figure 4:
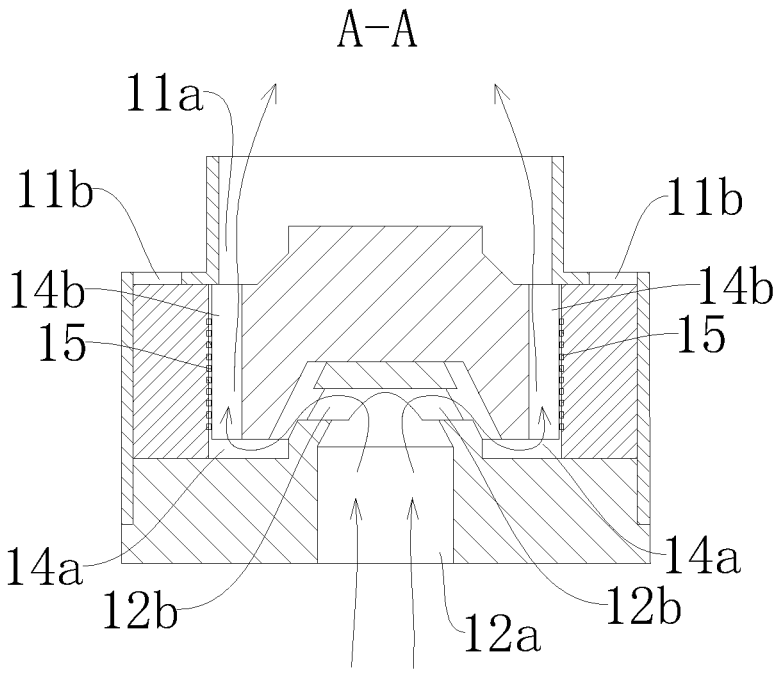
FIG. 4 is a sectional view of the atomizing unit of the first embodiment of the present disclosure at the position A-A in FIG. 2 (the arrow indicates a direction of an airflow)
Figure 5:
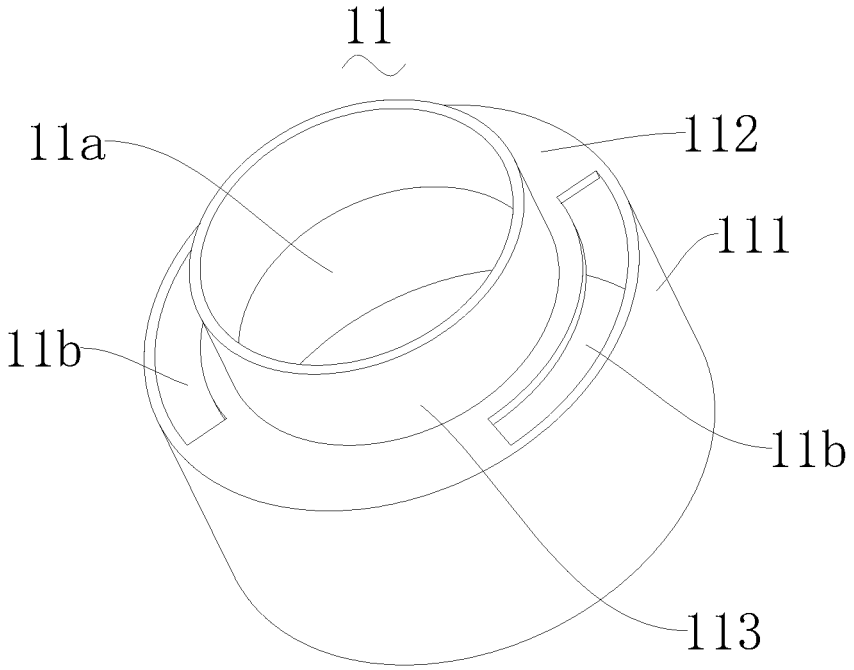
FIG. 5 is a perspective view of an outer cover of the atomizing unit of the first embodiment of the present disclosure.

The reference marks in the drawings: atomizing unit 1 with circuitous air passage;

outer cover, 11
first portion, 111;
second portion, 112;
third portion, 113;
third air hole, 11*a;*
liquid inlet hole, 11*b;*
base, 12;
first air hole, 12*a;*
second air hole, 12*b;*
protruding portion, 121;
liquid conducting member, 13;
accommodating cavity, 131;
supporting member, 14;
groove, 141;
recess, 142;
heat dissipation groove, 143;
ventilation passage, 14*b;*
air space, 14*a;*
heating member, 15;
housing, 2;
air outlet passage, 2*a;*
liquid storage cavity, 2*b;*
upper cover, 3; and
fourth air hole, 3*a.*

EMBODIMENTS

For clearly understanding technical features, purpose, and effect of the present disclosure, embodiments are given in detail hereinafter with reference to the accompanying drawings. It is understood that the orientation or the position relationship indicated by relative terms such as "front", "rear", "upper", "lower", "left", "right", "longitudinal", "lateral", "vertical", "horizontal", "top", "bottom", "inner", "outer", "head", and "tail" should be construed to refer to the orientation or the position relationship as then described or as illustrated in the drawings under discussion. These relative terms are for convenience of description and do not require that the present disclosure be constructed or operated in a particular orientation, and therefore cannot be understood as a limitation of the present disclosure. It is further noted that, in the present disclosure, unless specified or limited otherwise, the terms "mounted", "connected", "coupled", "fixed", "arranged" and the like are used broadly, and can be, for example, fixed connections, detachable connections, or integral connections; can be mechanical or electrical connections; can be direct connections or indirect connections via intervening structures; can be inner communications of two elements or interaction between two elements. When one element is described to be "located on" or "located under" another element, it means that the element can be "directly" or "indirectly" located on another element, or there may be one or more intervening element located therebetween. The terms "first", "second", "third" and the like are only used for the convenience of describing the technical solution, and cannot be understood as indicating or implying the relative importance or implicitly indicating the number of the indicated technical features. Therefore, features defined with "first", "second", "third", etc. may explicitly or implicitly indicates that one or more of these features can be included. For those of ordinary skill in the art, the specific meaning of the above-mentioned terms in the present disclosure can be understood according to specific circumstances.

In the description hereinbelow, for purposes of explanation rather than limitation, specific details such as specific systematic architectures and techniques are set forth in order to provide a thorough understanding of the embodiments of the present disclosure. However, it should be apparent to persons skilled in the art that the present disclosure may also be implemented in absence of such specific details in other embodiments. In other instances, detailed descriptions of well-known systems, devices, circuits, and methods are omitted so as not to obscure the description of the present disclosure with unnecessary detail.

Referring to FIGS. 1 to 5, an atomizing unit with a circuitous air passage in an embodiment of the present disclosure includes:

- a base 12, wherein a first air hole 12*a* is defined in a bottom surface of the base 12, and a second air hole 12*b* is defined in a top surface of the base 12, and the first air hole 12*a* is communicated with the second air hole 12*b;*
- an outer cover 11, wherein the outer cover 11 is arranged on the base 12, and a third air hole 11*a* is defined in the outer cover 11;
- a liquid conducting member 13, wherein the liquid conducting member 13 is arranged in the outer cover 11, and the liquid conducting member 13 defines an accommodating cavity 131 extending along a longitudinal direction and communicating with an upper side and a lower side of the liquid conducting member 13;
- a supporting member 14, wherein the supporting member 14 is arranged in the accommodating cavity 131, and a groove 141 extending along a longitudinal direction is defined in an outer side of the supporting member 14, and the second air hole 12*b* faces a bottom surface of the supporting member 14; and
- a heating member 15, wherein the heating member 15 is arranged in the accommodating cavity 131 and is located between the liquid conducting member 13 and the supporting member 14; the heating member 15 can be sheet shaped; the supporting member 14 supports the heating member 15 such that the heating member 15 can be attached to an inner side of the liquid conducting member 13, and the liquid conducting member 13 can conduct liquid to the heating member 15; the heating member 15 covers the groove 141 of the supporting member 14, so that the groove 141 and the heating member 15 define a ventilation passage 14*b*, and the ventilation passage 14*b* is communicated with the third air hole 11*a*.

At least a part of the bottom surface of the supporting member 14 is spaced from the base 12, or is kept at a distance from the base 12, to define an air space 14*a*. The air space 14*a* communicates the second air hole 12*b* with the ventilation passage 14*b*, thus, airflow can sequentially pass through the first air hole 12*a*, the second air hole 12*b*, the air space 14*a*, the ventilation passage 14*b*, and the third air hole 11*a* to take the aerosol generated by the heating member 15 out of the atomizing unit.

The liquid conducting member 13, the supporting member 14, and the heating member 15 are integrated in the outer cover 11, and the first air hole 12*a*, the second air hole 12*b*, the air space 14*a*, the ventilation passage 14*b* and the third air hole 11*a* define a circuitous air passage to avoid the leakage of the condensate or other liquid generated in the air passage.

A liquid inlet hole 11*b* is formed in the outer cover 11 to communicate the liquid conducting member 13 with an outer side of the outer cover 11. In the outer cover 11, the liquid inlet hole 11*b* is separated from the ventilation passage 14*b* and the air space 14*a* such that the liquid outside the outer cover 11 can contact the liquid conducting member 13 and thus the liquid can be conducted to the heating member 15 through the liquid conducting member 13. The liquid inlet hole 11*b* is arranged at a position where the liquid conducting member 13 is in contact with the outer cover 11, and the liquid inlet hole 11*b* is arranged on an outer periphery of the third air hole 11*a*. The outer cover 11 is configured to fix the porous liquid conducting material, and the liquid inlet hole is configured to control the quantity of the inlet liquid to avoid the liquid leakage caused by excessive liquid or to avoid dry burning due to insufficient liquid and high temperature. The liquid enters the atomizing unit through the liquid inlet hole 11*b* of the outer cover 11, and is conducted to the heating member 15 through the porous liquid conducting member 13. When the heating member 15 is electrified, the heating member 15 starts to generate heat, and heat the liquid on the liquid conducting member 13 which is attached to the heating member 15 to generate aerosol. The airflow enters the atomizing unit through the first air hole 12*a* of the base 12 and take the aerosol out of the atomizing unit through the circuitous air passage.

A protruding portion 121 is provided on a top surface of the base 12. The protruding portion 121 can be a truncated cone, a truncated pyramid, a cylinder, or a prism. The atomizing unit includes at least one of the second air hole 12*b* and the at least one second air hole 12*b* is defined in a top surface and/or a side surface of the protruding portion 121. In the embodiment shown in FIGS. 1 to 5, the atomizing unit includes a plurality of the second air holes 12*b*, which are distributed along a circumferential direction in the side surface of the protruding portion 121, and the protruding portion 121 is in the shape of a truncated cone. The protruding portion 121 can more effectively prevent the leakage of the condensate or other liquid formed in the air passage.

A recess 142 corresponding to the protruding portion 121 is formed in a bottom surface of the supporting member 14. The recess 142 is distanced from the protruding portion 121 to for allowing the airflow to pass therethrough. The groove 141 extends longitudinally, extending from the bottom surface to the top surface of the supporting member 14. The atomizing unit may include at least two grooves 141 and the at least two grooves 141 are distributed along a circumferential direction of the supporting member 14. Protruding portions on a side of the supporting member 14 are supporting portions in contact with the heating member 15, such that the supporting member 14 is gear-shaped. The liquid conducting member 13 may be made of porous material such as porous ceramic material. The supporting member 14 is optionally made of insulating material with a temperature resistance being greater than 200 degrees. The heating sheet is supported by the supporting member 14 and will not be warped due to high temperature or other reasons to avoid poor contact with the liquid conducting member 13.

Referring to FIGS. 11 to 14, a heat dissipation groove 143 extending along a circumferential direction of the supporting member 14 is formed in the supporting member 14, to facilitate the heat dissipation of the heating member 15. The supporting member 14 may include at least one heat dissipation groove 143, or at least two heat dissipation grooves 143 distributed along an axial direction of the supporting member 14.

Figure 6:
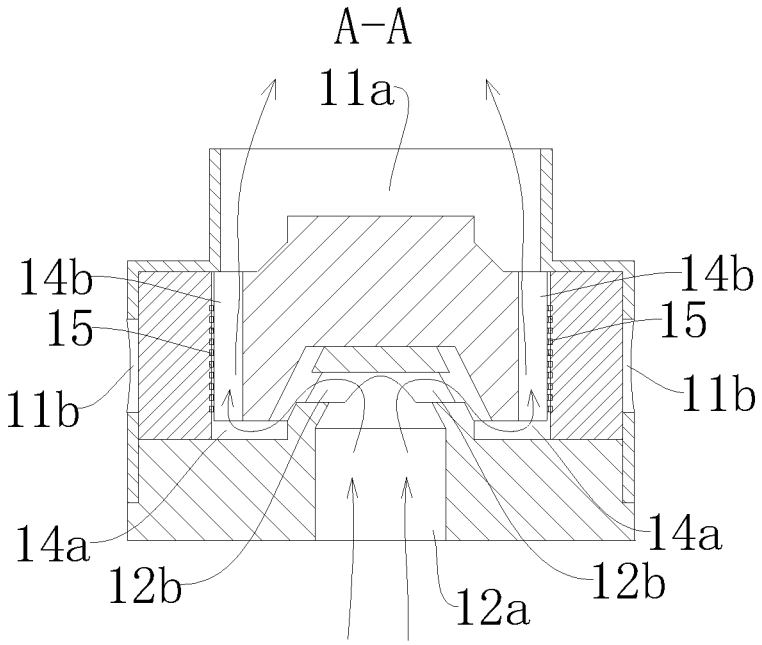
FIG. 6 is a sectional view of an atomizing unit of a second embodiment of the present disclosure at the position A-A in FIG. 2 (the arrow indicates a direction of an airflow)
Figure 7:
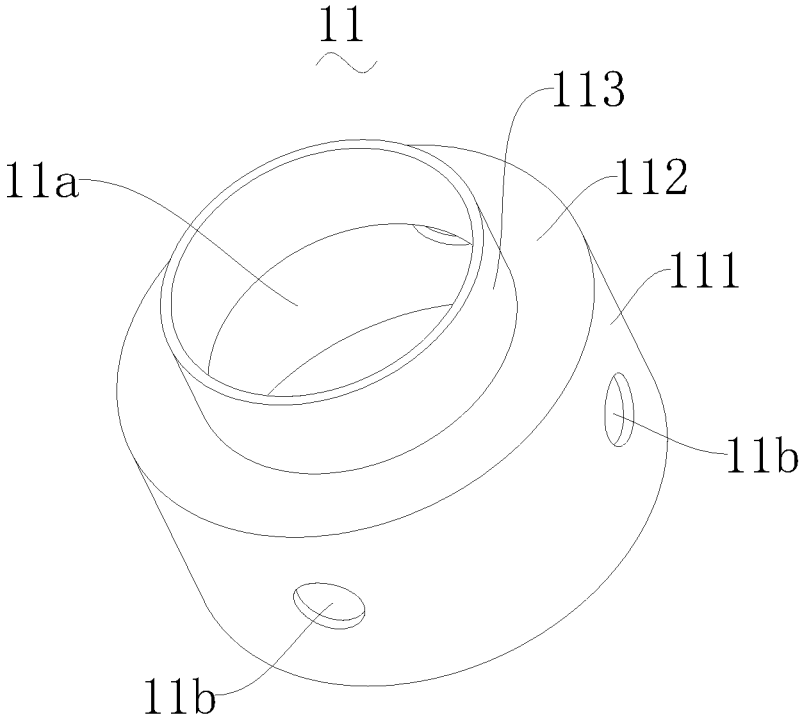
FIG. 7 is a perspective view of an outer cover of the atomization unit of the second embodiment of the present disclosure.
Figure 8:
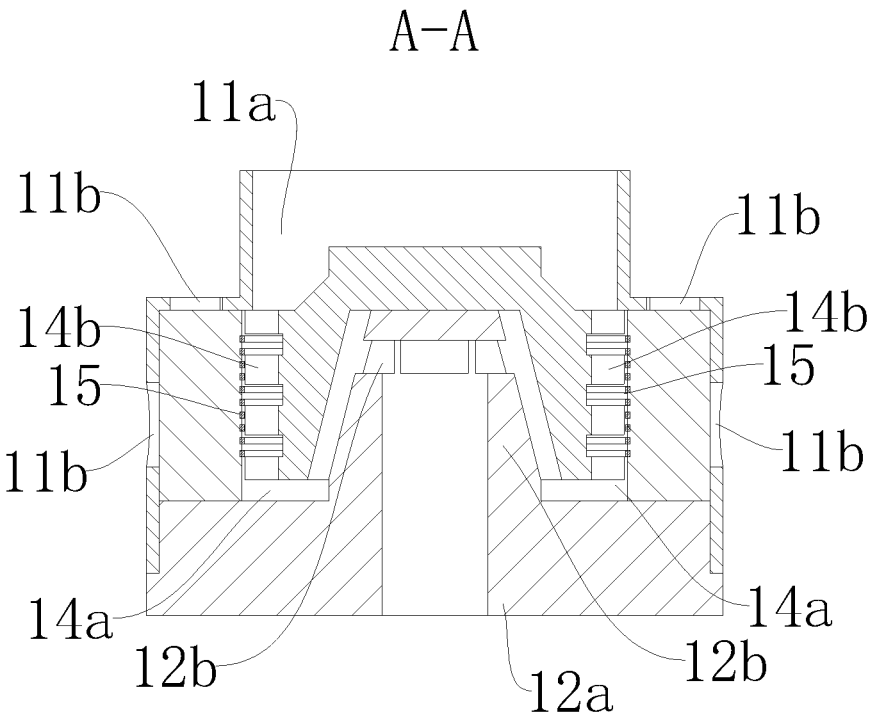
FIG. 8 is a sectional view of an atomizing unit of a third embodiment of the present disclosure at the position A-A in FIG. 2 (the arrow indicates a direction of an airflow)
Figure 9:
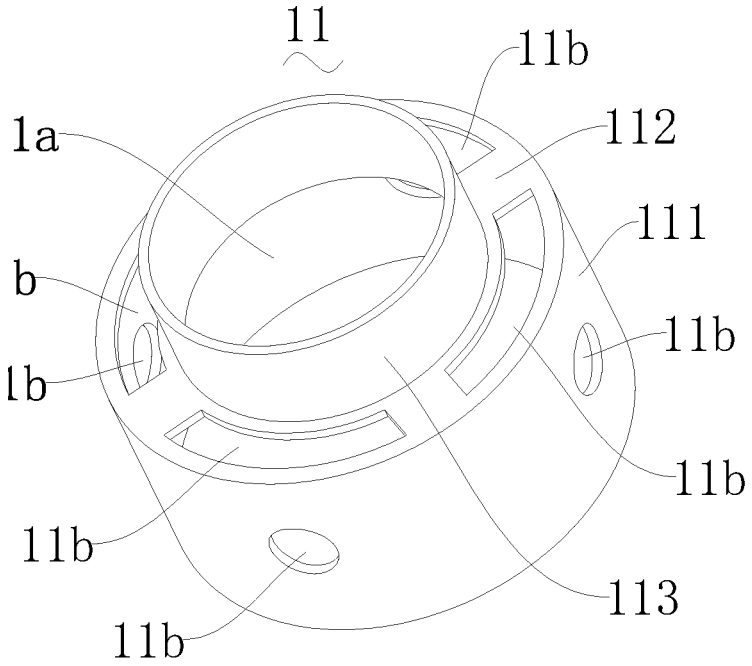
FIG. 9 is a perspective view of an outer cover of the atomizing unit of the third embodiment of the present disclosure.

The outer cover 11 includes a first portion 111 standing on the base 12 and a second portion 112 connected with an upper edge of the first portion 111 and extending laterally inwards. The first portion 111 surrounds a side surface of the liquid conducting member 13 in a circumferential direction thereof, and the second portion 112 covers a top surface of the liquid conducting member 13. The third air hole 11*a* is defined in the second portion 112, at least a part of an outer side surface of the liquid conducting member 13 is attached to an inner side surface of the first portion 111 of the outer cover 11, and at least a part of the top surface of the liquid conducting member 13 is attached to an inner side surface of the second portion 112 of the outer cover 11. The liquid inlet hole 11*b* is formed in the first portion 111 and/or the second portion 112. In the embodiment of FIGS. 6-7, the liquid inlet hole 11*b* is formed in the first portion 111. In the embodiment of FIGS. 1-5, the liquid inlet hole 11*b* is formed in the second portion 112. In the embodiment of FIGS. 8-9, the liquid inlet hole 11*b* is formed in the first portion 111 and the second portion 112.

The outer cover 11 includes a third portion 113 standing on the second portion 112 and surrounding the third air hole 11*a*. In an embodiment, the first portion 111, and/or the second portion 112, and/or the third portion 113 are annular.

The liquid conducting member 13 is annular, and the outer cover 11 fixes the liquid conducting member 13 and completely encloses the liquid conducting member 13.

Figure 10:
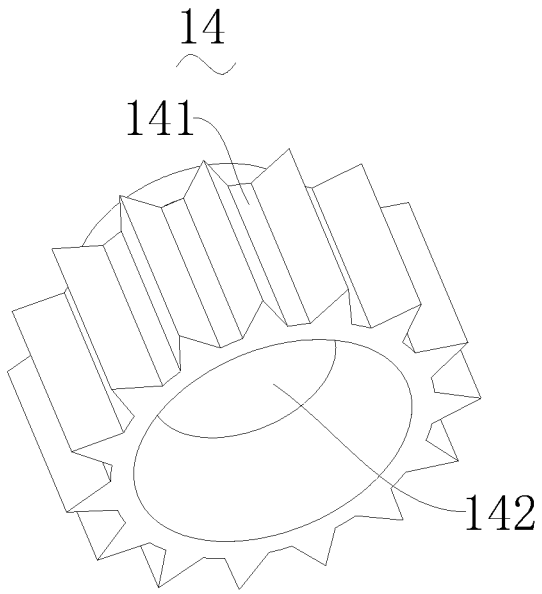
FIG. 10 is a perspective view of a supporting member of the atomizing unit of FIG. 1.
Figure 11:
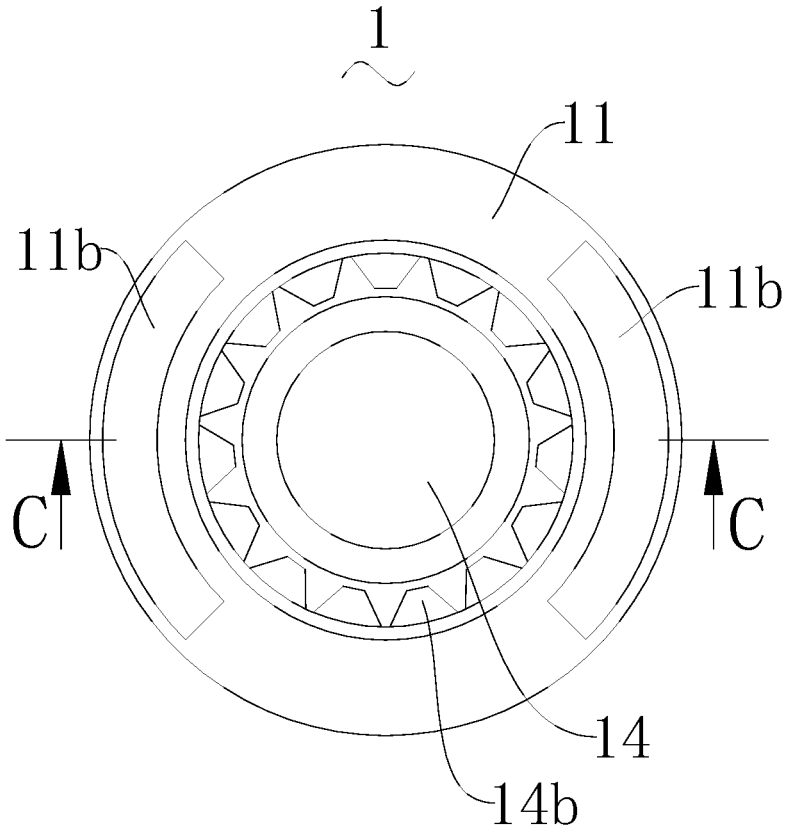
FIG. 11 is a top view of an atomizing unit according to a fourth embodiment of the present disclosure.
Figure 12:
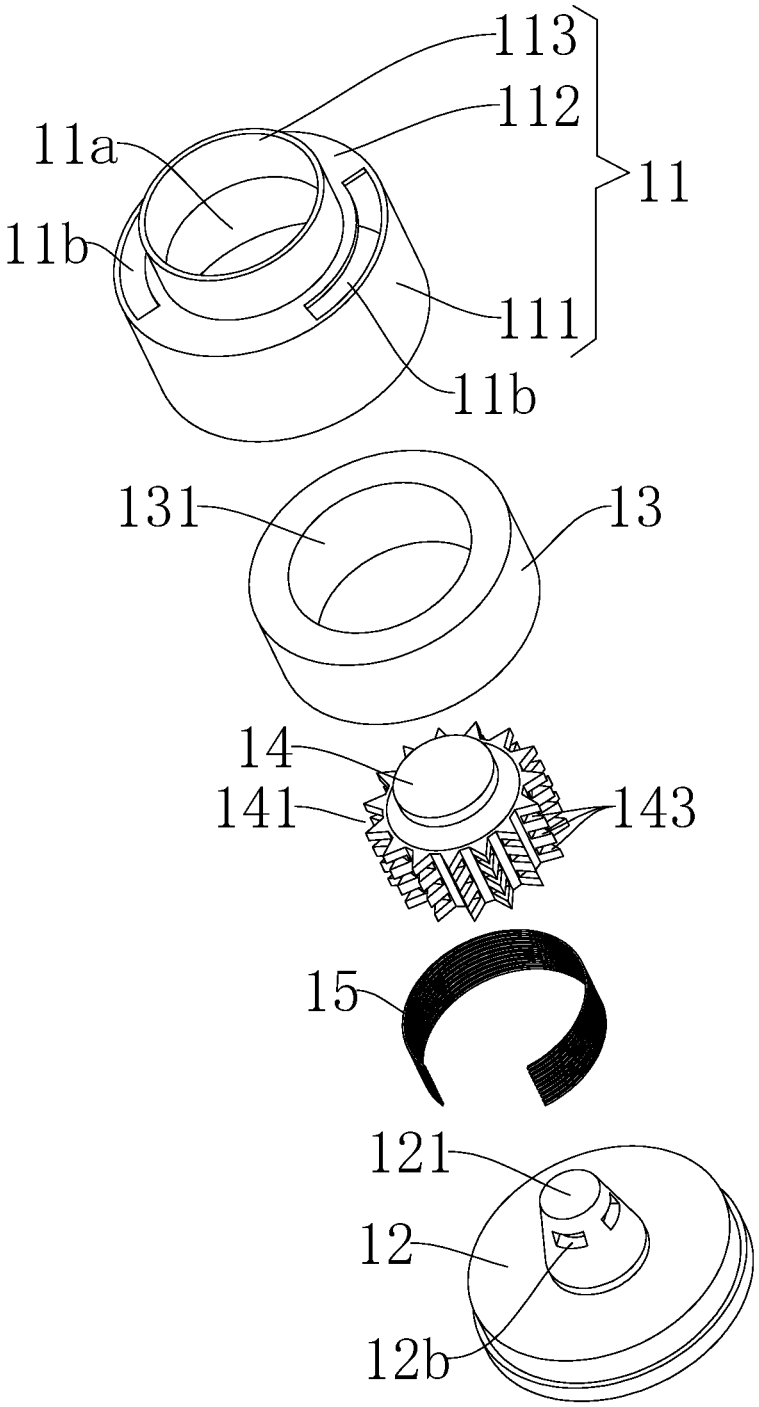
FIG. 12 is an exploded view of the atomizing unit of FIG. 11.
Figure 13:
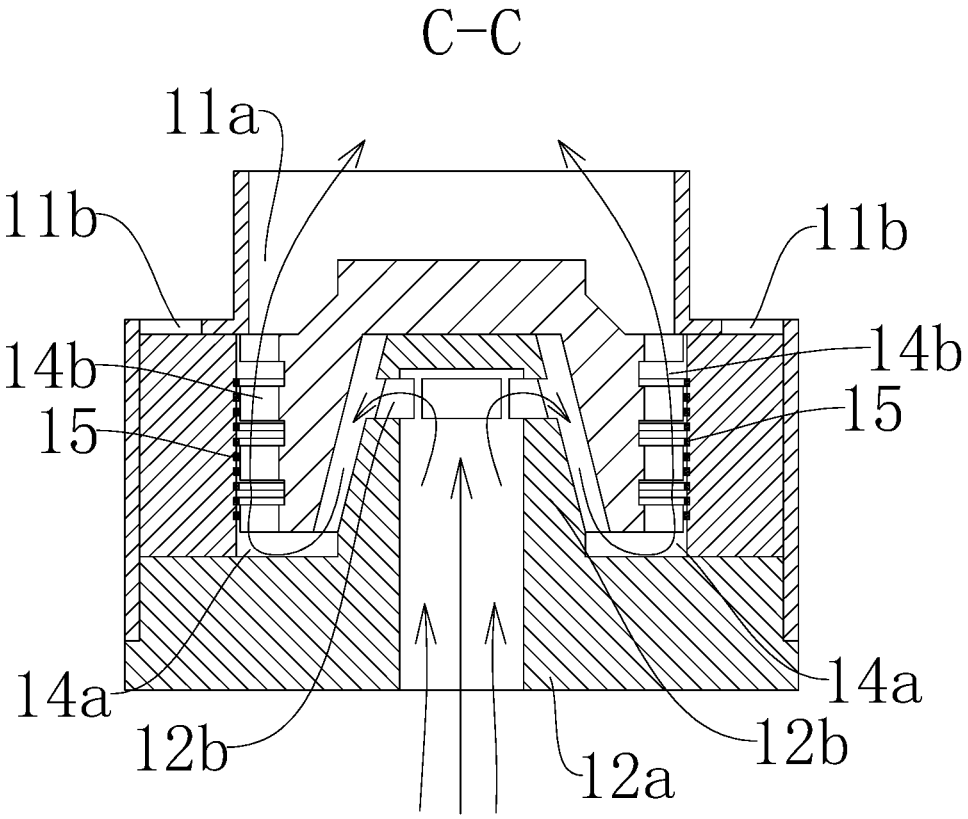
FIG. 13 is a sectional view of the atomizing unit of FIG. 11 at the position C-C.
Figure 14:
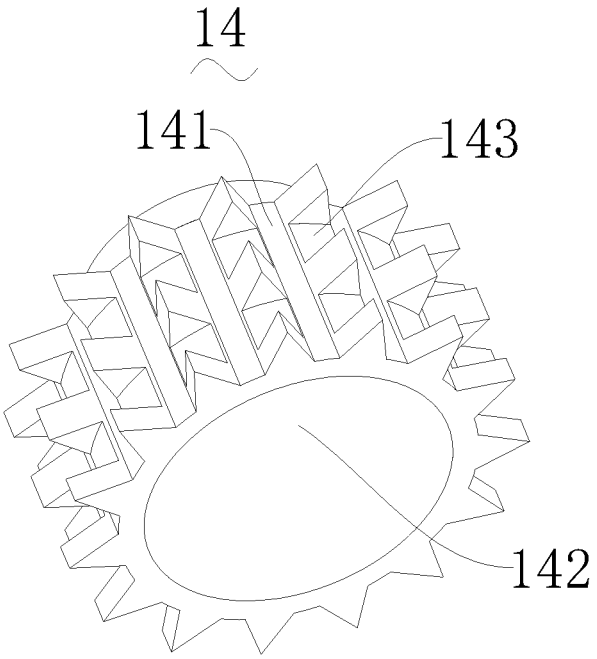
FIG. 14 is a perspective view of a supporting member of the atomizing unit of FIG. 11.
Figure 15:
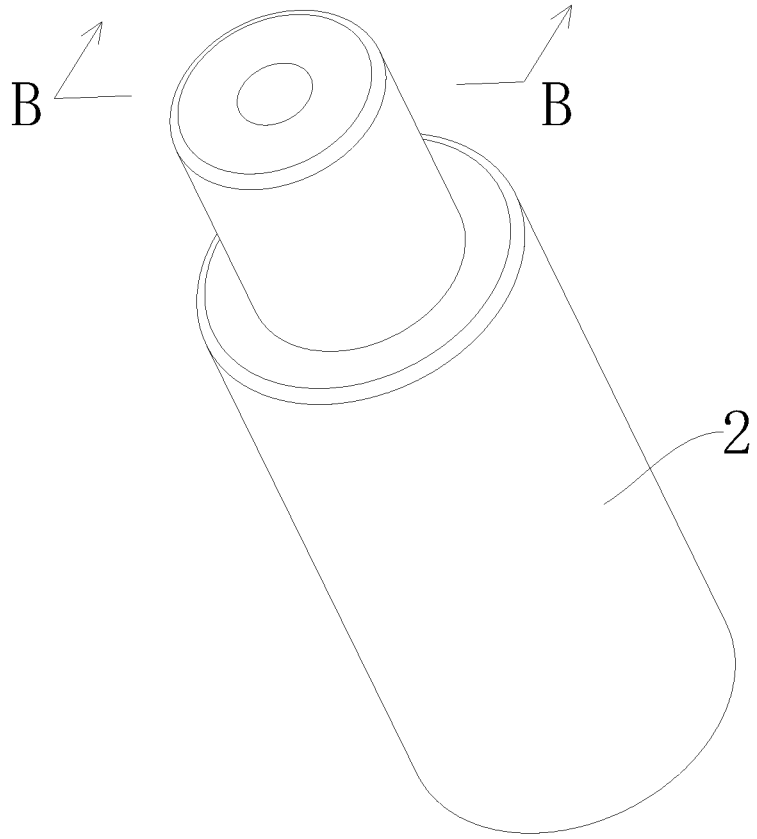
FIG. 15 is a perspective view of an atomization assembly according to an embodiment of the present disclosure.
Figure 16:
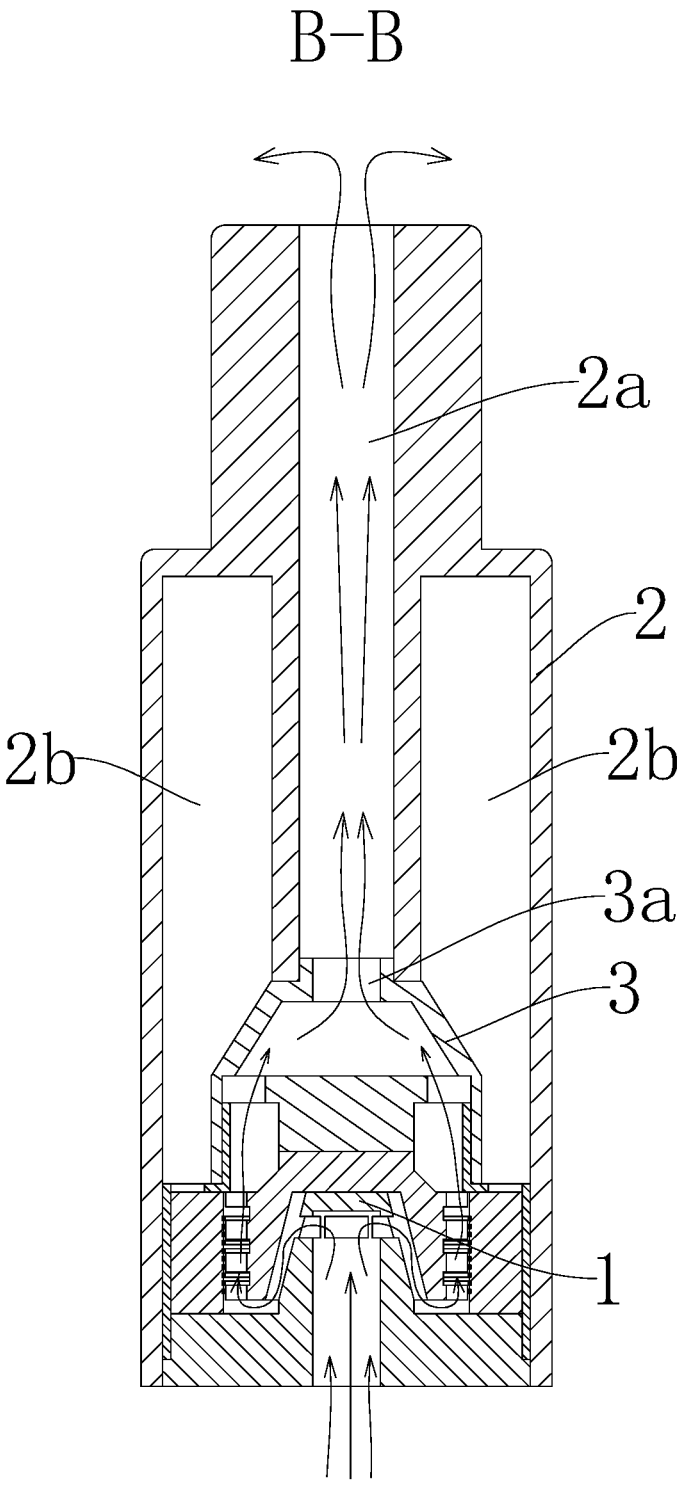
FIG. 16 is a sectional view of the atomization assembly at the position B-B in FIG. 15 (the arrow indicates a direction of an airflow).

Referring to FIGS. 15-16, the atomization assembly of an embodiment of the present disclosure includes a housing 2, an upper cover 3, and the above-mentioned atomizing unit 1 with the circuitous air passage. A liquid storage cavity 2*b* and an air outlet passage 2*a* are defined in the upper cover 3, and a fourth air hole 3*a* is defined in the upper cover 3. The upper cover 3 is connected with the atomizing unit and covers the third air hole 11*a*. The atomizing unit 1 with the circuitous air passage and the upper cover 3 are arranged in the housing 2, and the fourth air hole 3*a* is communicated with the air outlet passage 2*a*. The liquid storage cavity 2*b* is communicated with the liquid inlet hole 11*b*, so that the liquid in the liquid storage cavity 2*b* is in contact with the liquid conducting member 13 through the liquid inlet hole 11*b*, and is conducted to the heating member 15 via the liquid conducting member 13. Thus, the heating member 15 heats and atomizes the liquid, and the airflow sequentially passes through the first air hole 12*a*, the second air hole 12*b*, the air space 14*a*, the third air hole 11*a*, the fourth air hole 3*a* and the air outlet passage 2*a* to take the aerosol generated by the heating member 15 out of the atomization assembly. In an embodiment, a lower end opening of the upper cover 3 is connected with the third portion 113 of the outer cover 11. In the embodiment of FIGS. 9-10, the lower end opening of the upper cover 3 is plugged to the third portion 113.

In the atomization assembly using the above-mentioned atomizing unit 1 with the circuitous air passage, the first air hole 12*a*, the second air hole 12*b*, the air space 14*a*, the ventilation passage 14*b* and the third air hole 11*a* forms the circuitous air passage, which can prevent the leakage of the condensate or other liquid formed in the air passage. When the atomization assembly is applied to an electronic cigarette, the liquid storage cavity 2*b* is configured to store aerosol liquid, and the atomization assembly is configured to heat the aerosol liquid to generate smoke.

The foregoing descriptions are only preferred embodiments of the present disclosure and are not intended to limit the present disclosure. For those skilled in the art, the present disclosure can have various modifications, combinations and changes. Any modification, equivalent replacement, improvement, etc. made within the spirit and principle of the present disclosure shall be included in the scope of the claims of the present disclosure.

What is claimed is:

1. An atomizing unit with a circuitous air passage, wherein the atomizing unit comprises:

a base (12), wherein a first air hole (12*a*) is defined in a bottom surface of the base (12) and a second air hole (12*b*) is defined in a top surface thereof, and the first air hole (12*a*) is communicated with the second air hole (12*b*);

an outer cover (11), wherein the outer cover (11) is arranged on the base (12), and a third air hole (11*a*) is defined in the outer cover (11);

a liquid conducting member (13), wherein the liquid conducting member (13) is arranged in the outer cover (11), and an accommodating cavity (131) extending through two sides of the liquid conducting member (13) is defined in the liquid conducting member (13);

a supporting member (14), wherein the supporting member (14) is arranged in the accommodating cavity (131), and a groove (141) is defined in an outer side of the supporting member (14), and the second air hole (12*b*) faces a bottom surface of the supporting member (14); and a heating member (15), wherein the heating member (15) is arranged in the accommodating cavity (131) and located between the liquid conducting member (13) and the supporting member (14), and the supporting member (14) supports the heating member (15) to be attached to an inner side of the liquid conducting member (13) and the liquid conducting member (13) is configured to conduct liquid to the heating member (15); the heating member (15) covers the groove (141) of the supporting member (14) such that the groove (141) and the heating member (15) define an ventilation passage (14*b*), and the ventilation passage (14*b*) is communicated with the third air hole (11*a*);

wherein at least a part of the bottom surface of the supporting member (14) and the base (12) define an air space (14*a*), and the air space (14*a*) communicates the second air hole (12*b*) with the ventilation passage (14*b*) such that airflow passes through the first air hole (12*a*), the second air hole (12*b*), the air space (14*a*), the ventilation passage (14*b*) and the third air hole (11*a*) in sequence.

2. The atomizing unit with the circuitous air passage according to claim 1, wherein the outer cover (11) is provided with a liquid inlet hole (11*b*) communicating the liquid conducting member (13) with an outer side of the outer cover (11); in the outer cover (11), the liquid inlet hole (11*b*) is separated from the ventilation passage (14*b*) and the air space (14*a*), such that liquid outside the outer cover (11) is in contact with the liquid conducting member (13) and is then conducted to the heating member (15) via the liquid conducting member (13).

3. The atomizing unit with the circuitous air passage according to claim 2, wherein the liquid inlet hole (11*b*) is located at a position where the liquid conducting member (13) is in contact with the outer cover (11), and the liquid inlet hole (11*b*) is arranged on an outer periphery of the third air hole (11*a*).

4. The atomizing unit with the circuitous air passage according to claim 1, wherein a protruding portion (121) is provided on a top surface of the base (12), and the second air hole (12*b*) is defined in a top surface and/or a side surface of the protruding portion (121).

5. The atomizing unit with the circuitous air passage according to claim 4, wherein a recess (142) corresponding to the protruding portion (121) is defined in the bottom surface of the supporting member (14), and the recess (142) is distanced from the protruding portion (121) for airflow to pass therethrough.

6. The atomizing unit with the circuitous air passage according to claim 1, wherein the groove (141) extends longitudinally, from the bottom surface of the supporting member (14) to a top surface of the supporting member (14).

7. The atomizing unit with the circuitous air passage according to claim 1, wherein a heat dissipation groove (143) is defined in the supporting member (14) which extends in a circumferential direction of the supporting member (14).

8. The atomizing unit with the circuitous air passage according to claim 2, wherein the outer cover (11) comprises a first portion (111) standing on the base (12) and a second portion (112) connected to an upper edge of the first portion (11) and extending inwards, the first portion (111) circumferentially surrounds a side surface of the liquid conducting member (13), and the second portion (112) covers a top surface of the liquid conducting member (13), the third air hole (11*a*) is defined in the second portion (112), and the liquid inlet hole (11*b*) is defined in the first portion (111) and/or the second portion (112).

9. The atomizing unit with the circuitous air passage according to claim 8, wherein the outer cover (11) comprises a third portion (113) standing on the second portion (112) and surrounding the third air hole (11*a*).

10. The atomizing unit with the circuitous air passage according to claim 1, wherein the liquid conducting member (13) is annular.

11. An atomization assembly, comprising a housing (2), an upper cover (3), and an atomizing unit (1) with a circuitous air passage; wherein the atomizing unit (1) comprises:

a base (12), wherein a first air hole (12*a*) is defined in a bottom surface of the base (12) and a second air hole (12*b*) is defined in a top surface thereof, and the first air hole (12*a*) is communicated with the second air hole (12*b*);

an outer cover (11), wherein the outer cover (11) is arranged on the base (12), and a third air hole (11*a*) is defined in the outer cover (11);

a liquid conducting member (13), wherein the liquid conducting member (13) is arranged in the outer cover (11), and an accommodating cavity (131) extending through two sides of the liquid conducting member (13) is defined in the liquid conducting member (13);

a supporting member (14), wherein the supporting member (14) is arranged in the accommodating cavity (131), and a groove (141) is defined in an outer side of the supporting member (14), and the second air hole (12*b*) faces a bottom surface of the supporting member (14); and a heating member (15), wherein the heating member (15) is arranged in the accommodating cavity (131) and located between the liquid conducting member (13) and the supporting member (14), and the supporting member (14) supports the heating member (15) to be attached to an inner side of the liquid conducting member (13) and the liquid conducting member (13) is configured to conduct liquid to the heating member (15); the heating member (15) covers the groove (141) of the supporting member (14) such that the groove (141) and the heating member (15) define an ventilation passage (14*b*), and the ventilation passage (14*b*) is communicated with the third air hole (11*a*);

wherein at least a part of the bottom surface of the supporting member (14) and the base (12) define an air space (14*a*) to communicate the second air hole (12*b*) with the ventilation passage (14*b*); the first air hole (12*a*), the second air hole (12*b*), the air space (14*a*), the ventilation passage (14*b*) and the third air hole (11*a*) define the circuitous air passage; and wherein a liquid storage cavity (2*b*) and an air outlet passage (2*a*) are defined in the upper cover (3), a fourth air hole (3*a*) is defined in the upper cover (3), and the upper cover (3) covers the third air hole (11*a*); the atomizing unit (1) and the upper cover (3) are arranged in the housing (2), the fourth air hole (3*a*) is communicated with the air outlet passage (2*a*), such that airflow passes through the first air hole (12*a*), the second air hole (12*b*), and the air space (14*a*), the third air hole (11*a*), the fourth air hole (3*a*) and the air outlet passage (2*a*) in sequence.

12. The atomization assembly according to claim 11, wherein the outer cover (11) is provided with a liquid inlet hole (11*b*) communicating the liquid conducting member (13) with the liquid storage cavity (2*b*); in the outer cover (11), the liquid inlet hole (11*b*) is separated from the ventilation passage (14*b*) and the air space (14*a*), such that liquid outside the outer cover (11) is in contact with the liquid conducting member (13) and is then conducted to the heating member (15) via the liquid conducting member (13).

13. The atomization assembly according to claim 12, wherein the liquid inlet hole (11*b*) is located at a position where the liquid conducting member (13) is in contact with the outer cover (11), and the liquid inlet hole (11*b*) is arranged on an outer periphery of the third air hole (11*a*).

14. The atomization assembly according to claim 11, wherein a protruding portion (121) is provided on a top surface of the base (12), and the second air hole (12*b*) is defined in a top surface and/or a side surface of the protruding portion (121).

15. The atomization assembly according to claim 14, wherein a recess (142) corresponding to the protruding portion (121) is defined in the bottom surface of the supporting member (14), and the recess (142) is distanced from the protruding portion (121) for airflow to pass therethrough.

16. The atomization assembly according to claim 11, wherein the groove (141) extends longitudinally, from the bottom surface of the supporting member (14) to a top surface of the supporting member (14).

17. The atomization assembly according to claim 11, wherein a heat dissipation groove (143) is defined in the supporting member (14) which extends in a circumferential direction of the supporting member (14).

18. The atomization assembly according to claim 12, wherein the outer cover (11) comprises a first portion (111) standing on the base (12) and a second portion (112) connected to an upper edge of the first portion (11) and extending inwards, the first portion (111) circumferentially surrounds a side surface of the liquid conducting member (13), and the second portion (112) covers a top surface of the liquid conducting member (13), the third air hole (11*a*) is defined in the second portion (112), and the liquid inlet hole (11*b*) is defined in the first portion (111) and/or the second portion (112).

19. The atomization assembly according to claim 18, wherein the outer cover (11) comprises a third portion (113) standing on the second portion (112) and surrounding the third air hole (11*a*).

20. The atomization assembly according to claim 11, wherein the liquid conducting member (13) is annular.

* * * * *